US006019306A

United States Patent [19]

Cramer

[11] Patent Number: 6,019,306

[45] Date of Patent: Feb. 1, 2000

[54] ROLL WINDING DEVICE

[75] Inventor: Dirk Cramer, Duisburg, Germany

[73] Assignee: Voith Sulzer Finishing GmbH, Krefeld, Germany

[21] Appl. No.: 09/196,243

[22] Filed: Nov. 20, 1998

[30] Foreign Application Priority Data

Nov. 25, 1997 [DE] Germany ..... 197 52 112

[51] Int. Cl.[7] ..... B65H 18/08

[52] U.S. Cl. ..... 242/530.4; 242/538.1; 242/541.1; 242/541.4

[58] Field of Search ..... 242/530.4, 538, 242/538.1, 538.2, 541, 541.1, 541.4

[56] References Cited

U.S. PATENT DOCUMENTS

| | | | |
|---|---|---|---|
| B 396,551 | 1/1975 | Jores et al. . | |
| 3,777,998 | 12/1973 | Jores et al. . | |
| 3,921,929 | 11/1975 | Jöres et al. . | |
| 4,458,853 | 7/1984 | Heymanns | 242/541.4 |
| 4,729,520 | 3/1988 | Kataoka | 242/530.4 |
| 5,016,832 | 5/1991 | Curtis, Jr. et al. | 242/538.1 |
| 5,152,471 | 10/1992 | Goerner | 242/530.4 |

FOREIGN PATENT DOCUMENTS

| | | |
|---|---|---|
| 1521131 | 3/1968 | France . |
| 885085 | 8/1953 | Germany . |
| 1253546 | 11/1967 | Germany . |
| 2106865 | 8/1972 | Germany . |
| 19734830 | 2/1999 | Germany . |

*Primary Examiner*—Donald P. Walsh
*Assistant Examiner*—William A. Rivera
*Attorney, Agent, or Firm*—Greenblum & Bernstein, P.L.C.

[57] ABSTRACT

Roll winding device that includes an unwinding station and a winding station and method for winding at least one winding roll. At least one of the unwinding station and the winding station includes a pivotable rotational axis adapted to pivot between a substantially vertical orientation and a substantially horizontal orientation. The method includes substantially horizontally orienting a rotational axis of at least one of the at least one winding roll and the jumbo roll, pivoting the rotational axis, and substantially vertically orienting the rotational axis.

19 Claims, 1 Drawing Sheet

ROLL WINDING DEVICE

CROSS-REFERENCE TO RELATED APPLICATIONS

The present application claims priority under 35 U.S.C. §119 of Gennan Patent Application No. 197 52 112.6, filed on Nov. 25, 1997, the disclosure of which is expressly incorporated by reference herein in its entirety.

BACKGROUND OF THE INVENTION

1. Field of the Invention

The present invention relates to a roll winding device with an unwinding station and a winding station. This type of roll winding device may be utilized, e.g., in the unwinding and subsequent winding up of material web rolls. Applications for the roll winding device of the present invention may include, e.g., rewinding or cutting of rolls from an operational width of the production machine to a usable width for consumers.

2. Discussion of the Background Information

Material webs, e.g., paper or cardboard webs, are generally wound onto winding cores made of cardboard tubes for distribution after production. These winding rolls, and in particular, wide winding rolls, are generally supported by carrying rolls or backing rolls during the winding procedure because the cardboard tubes do not have the necessary rigidity and bearing capacity to avoid a bending of the roll due to the increasing roll weight.

Progress in paper production, as well as demands of consumers, e.g., printers, have led to a stark increase in the dimensions and weights of paper rolls. This increased size consequently increases the pressure with which the winding rolls rest against the carrying rolls or backing rolls during the winding procedure. As a result, imperfections in roll assembly are cause, e.g., formation of bars or crepe creases. In addition to these drawbacks, the higher roll weight on the winding location results in a higher pressure, which results in greater winding tightness and other problems. Moreover, because the weight increases with the increase of the roll diameter, winding tightness increases outwardly from the inside of the roll, which is basically undesirable. In fact, the opposite tightness progression is much more desirable, i.e., an outwardly decreasing winding tightness from the inside of the roll.

In an attempt to compensate for the influence of the roll weight, compressed air bearers, air cushions, or belt relief mechanisms have been used. However, this compensation is difficult because, e.g., roll supports with air cushions or compressed air bearers require a considerable amount of energy. This becomes immediately apparent when it is considered that the rolls to be wound will have a diameter in the range of between 1,000 and 2,100 mm and a width between 400 and 3,800 mm. Moreover, the weight of the wound rolls will generally be within a range, e.g., between 3 and 10 tons. Further, in spite of these very high masses, a high production speed should nevertheless be attained, e.g., up to 3,500 m/min.

German patent application 197 34 830 discloses that vertically arranging the axis of rotation can be used to overcome the above-noted problem. In this arrangement, at least the material web runs on a vertical plane in one area either shortly before winding onto the roll or after leaving the roll. When resting on a support or stand, the winding roll can no longer produce radial forces with its own weight.

However, when winding in this manner, i.e., winding with a vertically positioned axis of rotation, it is not very easy to access the material web at the beginning of the winding process. The broader the material web or partial web to be wound, the greater the height at which an operator must work, e.g., when fastening the partial web or material web onto the roll core. Further, due to the weight of the material web roll itself, crease formation is sometimes observed, which reduces the winding result.

SUMMARY OF THE INVENTION

The present invention provides a roll winding device which is also useable for large rolls that does not suffer from the drawbacks of the prior art.

The present invention provides a roll winding device of the type generally described above having two winding stations. Further, at least one of the two winding stations may be operable with a substantially vertically standing axis of rotation. The axis of rotation can be pivoted between its substantially vertically aligned winding position and a set-up position that is substantially horizontal.

The winding process of the present invention takes advantage of substantially vertical winding, i.e., winding with the axis of rotation being substantially vertically oriented, without sacrificing relatively convenient access to the paper web to be wound during set-up, i.e., at the beginning or end of a winding procedure. This may apply, not only to the unwinding station, where it is easier to pull the material web off of a substantially horizontally oriented roll, e.g., a "jumbo" or parent roll, but also to the winding station, where it is much easier to access a material web or partial web arranged in a substantially horizontally oriented plane. In this way, personnel may, e.g., walk along the roll core to fasten the material web or partial web thereto. It may also be significantly easier to obtain a crease-free winding-up of the material web or partial web on the roll core by performing the first rotations to form a winding roll with a substantially horizontally oriented axis. At the beginning of winding, the weight of the winding roll is not yet so great as to result in a sagging problem worth noting. However, as soon as the material web or partial web can be fed with a certain tension without the danger of the web slipping from the roll core, the axis of rotation may be pivoted from its substantially horizontal orientation to a substantially vertical orientation.

The axes of rotation of both winding stations may preferably be pivotable. In this manner, when either unwinding or winding up, the advantages of easy access at set-up and of weight relief during winding may be utilized.

A coupling device for synchronizing the pivoting of the axes of rotation may preferably be provided. In this way, the material web which is being unwound from a jumbo or parent roll in the unwinding station may be kept "flat". However, deflection rolls may still be used as before to direct the path of the material web. The axes of rotation of the deflection rolls may be oriented to be substantially perpendicular to a travel direction the material web, however, it is not necessary for the material web to be directed from the direction in which it is running.

In the exemplary embodiment, both winding stations may be arranged on a common support that is pivotably coupled to a hinge pin running substantially perpendicular to the axes of rotation. When the support is pivoted into a position to substantially horizontally orient the axes of rotation, i.e., position the axes to be level, the material web in the unwinding station can be removed, and, with the same alignment, be fed onto the winding station. As soon as a connection between the unwinding station and the winding station is established, and as soon as winding-up is possible, the support may be pivoted approximately 90 degrees so that the axes of rotation are substantially vertically oriented.

In the exemplary embodiment, it may be advantageous to laterally offset the hinge pin from at least one axis of rotation. The hinge pin may be located, e.g., adjacent to the substantially horizontally oriented axes of rotation, but in a different plane, e.g., within a plane that includes the support. In this manner, there is more freedom with the structural development of the roll winding device.

The hinge pin may preferably be located in a middle portion of the support. As long as the axes of rotation are substantially horizontally oriented, the entire arrangement will be at least approximately in a state of equilibrium. In this manner, the forces necessary for rotation can be kept at a lower level.

The support may preferably be located in an opening in a mounting plate. The mounting plate can be made of, e.g., a cover between two levels or a platform in an engine frame. An operator may cross over from the mounting plate to the support, which is expressly designed to be level to this end to start the necessary set-up work in the unwinding station or the winding station.

It may be particularly advantageous to have a cutting station on the support. Then the roll winding device may be utilized as a reel cutter. Moreover, because the cutting station may be arranged to move together with the unwinding station and the winding station, the material web or the resulting partial webs may be prepared in a relatively comfortable working position and may be placed onto the winding cores of the partial web rolls. When the winding procedure has begun, the support may be pivoted and the reel cutter may be operated with substantially vertically oriented axes of rotation.

The support advantageously includes a rotating drive. Via the rotating drive, rotation of the support may be directed.

Accordingly, the present invention is directed to a roll winding device that includes an unwinding station and a winding station. At least one of the unwinding station and the winding station includes a pivotable rotational axis adapted to pivot between a substantially vertical orientation and a substantially horizontal orientation.

In accordance with another feature of the present invention, the substantially vertical orientation of the pivotable rotational axis is a winding position, and the substantially horizontal orientation of the pivotable rotational axis is a set-up position.

In accordance with another feature of the present invention, both the unwinding station and the winding station include pivotable rotational axes adapted to pivot between a substantially vertical orientation and a substantially horizontal orientation. Further, a coupling device adapted for synchronously pivoting of the pivotable rotational axes may be provided. Still further, a common support may be provided. Both the unwinding station and the winding station may be coupled to the support. A hinge pin may be coupled to the support to form a rotational axis of the support that is substantially perpendicular to the pivotable rotational axes.

In accordance with a further feature of the present invention, the hinge pin may be laterally offset from the pivotable axes rotation.

In accordance with a still further feature of the present invention, the hinge pin may be positioned in a middle of the support.

In accordance with a still further feature of the present invention, a mounting plate having an opening may be provided, and the support may be is arranged in the opening in a mounting plate.

In accordance with still another feature of the present invention, a cutting station may be coupled to the support.

In accordance with another feature of the present invention, a rotational drive may be coupled to the support.

In accordance with yet another feature of the present invention, a load roll may be adapted to pivotably rotate with the pivotable rotational axis.

The present invention may also be directed to a method for winding at least one winding roll from a jumbo roll, in which the at least one winding roll and the jumbo roll are coupled to a pivotable support. The method includes substantially horizontally orienting a rotational axis of at least one of the at least one winding roll and the jumbo roll, pivoting the rotational axis, and substantially vertically orienting the rotational axis.

In accordance with another feature of the present invention, while the rotational axis is substantially horizontally oriented, guiding a material web from the jumbo roll to the at least one winding roll, and winding the material web onto the at least one winding roll.

In accordance with another feature of the present invention, while the rotational axis is substantially vertically oriented, winding the material web onto the at least one winding roll.

In accordance with still another feature of the present invention, the at least one winding roll includes a plurality of winding rolls, and the method may further include cutting the material web into a plurality of partial webs, and winding the plurality of partial webs onto the plurality of winding rolls.

In accordance with a further feature of the present invention, the method may further include pivoting the rotational axis around an axis formed by a hinge pin laterally offset from the rotational axis.

In accordance with a still further feature of the present invention, the pivoting of the rotational axis may include pivoting the support.

In accordance with another feature of the present invention, the at least one winding roll includes a plurality of winding rolls, and the method may further include substantially horizontally orienting rotational axes of the plurality of winding rolls and of the jumbo roll, and pivoting the rotational axes.

In accordance with yet another feature of the present invention, the method may further include positioning a load roll against the at least one winding roll. The method may also include pivoting the load roll with the rotational axis.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

In the exemplary embodiment of the present invention, the material web is described as a paper web. However, it is noted that this description is merely for the purpose of explanation and should not be construed as limiting. In fact, it is noted that other material webs, e.g., foils, fabric, etc., may also be utilized in accordance with the features of the present invention without departing from the spirit of the invention.

Figure 1:
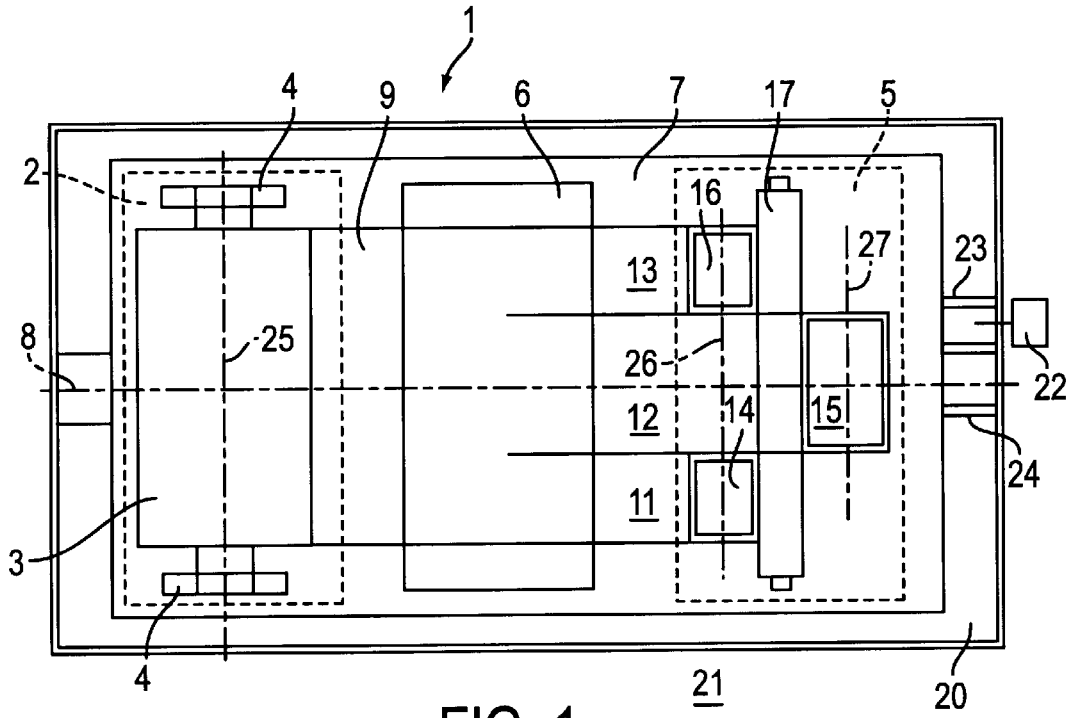
FIG. 1 illustrates a top view of a reel cutter with substantially horizontally oriented axes of rotation.
Figure 2:
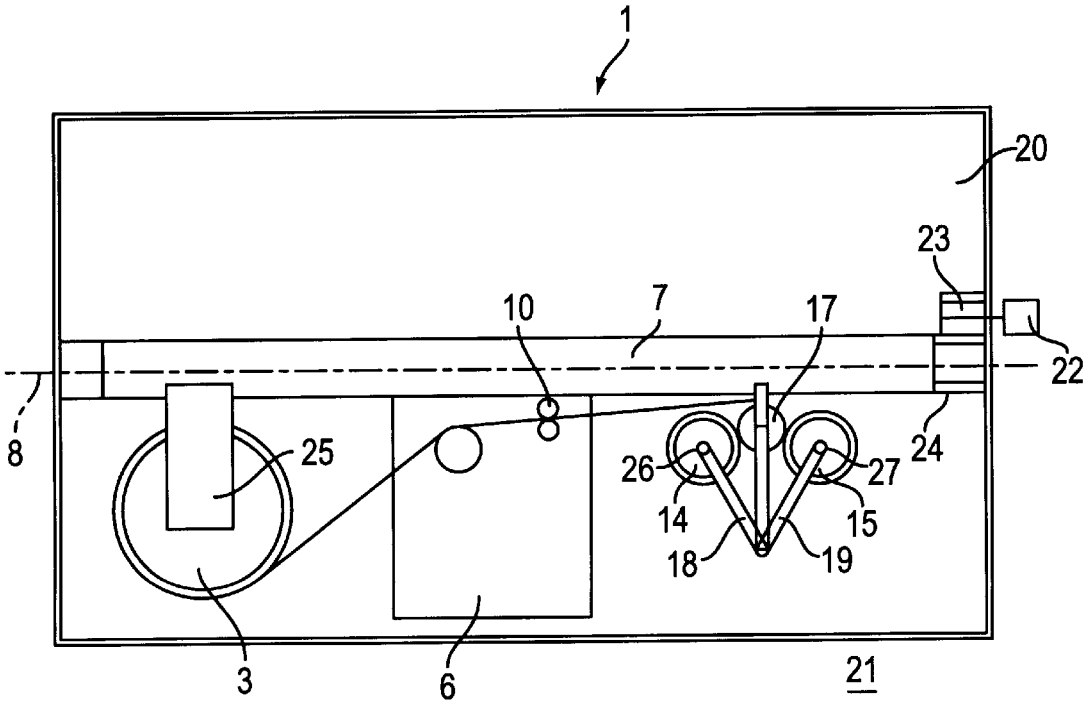
FIG. 2 illustrates a top view of a reel cutter depicted in FIG. 1, which has been pivoted to substantially vertically orient the axes of rotation.

FIGS. 1 and 2 illustrate a reel cutter 1 that includes an unwinding station 2, a winding station 5, and a cutting station 6 positioned therebetween. Unwinding station 2 may include a bearing block 4 on which a "jumbo" or parent roll 3 may be rotatably mounted. Unwinding station 2, winding station 5, and cutting station 6 may be arranged on, and coupled to, a common support 7. Common support 7 may be pivotably mounted in an opening of a mounting plate 21 via hinge pin 8. In this manner, common support 7 may be pivotable on hinge pin 8 over a range of approximately 90°, as shown in FIGS. 1, e.g., approximately 0°, and in FIG. 2, e.g., approximately 90°.

In unwinding station 2, a material web 9, e.g., a paper web, may be removed or unwound from jumbo roll 3. Thus, during this process, jumbo roll 3 is turning or rotating about a rotational axis 25. In cutting station 6, cutting blades 10 may be arranged to cut material web 9 in a lengthwise manner, thereby producing a plurality of partial webs, e.g., partial webs 11, 12, and 13, which are to be wound into partial web rolls 14, 15, and 16 in winding station 5. As is known to those ordinarily skilled in the art, partial web rolls 14, 15, and 16 may be arranged in at least two different winding position groups.

In FIG. 1, support 7 is shown in a position such that rotational axis 25 of jumbo roll 3, rotational axis 26 of partial web rolls 14 and 16, and rotational axis 27 of partial web roll 15 are substantially horizontally oriented, i.e., parallel to mounting plate 21. Thus, support 7, which is in the form of a plate, is also substantially horizontally oriented. This position or orientation of the rotational axes may be referred to as the "set-up position". In the set-up position, an operator may remove material web 9 from jumbo roll 3 with relative case, feed material web 9 through cutting station 6, and place the partial webs 11, 12, and 13 on respective paper cores (not further described) that form the cores of partial web rolls 14, 15, and 16. The placement of partial webs 11, 12, and 13 on the paper cores may be facilitated with, e.g., gummed tape.

At the beginning of the winding process, the weight of the partial web rolls is not yet a factor worth mentioning. Thus, the rotational axes are oriented substantially horizontally, and the winding tightness may be controlled with an external control device, e.g., a rider or load roll 17. However, as the weight of the partial web rolls 14, 15, and 16 increases, the force of weight begins to exert an increasing amount of influence on the tension with which the partial web plies are wound onto the partial web rolls. To avoid this influence, support 7 may be pivoted on hinge pin 8 so that the axes of rotation of partial web rolls 14, 15, and 16 and of jumbo roll 3, as shown in FIG. 2, are likewise rotated to be substantially vertically oriented.

Partial web rolls 14, 15, and 16, may be coupled to, e.g., bearing arms 18 and 19, as shown in FIG. 2, that may be coupled to support 7. Further, while arms 18 and 19 may be sufficient to hold the winding rolls in the desired winding positions, both in the substantially horizontal and the substantially vertical orientations, other alternative and/or additional devices may be utilized, e.g., clamping discs. Further, bearing arms 18 and 19 may also be utilized to hold load roll 17. In this substantially vertically oriented position, partial web rolls 14, 15, and 16 may continue to be wound. However, the substantially vertical arrangement of the partial web rolls substantially eliminates the force due to the weight of the rolls from contributing to winding tightness, i.e., a downward (gravitational force) is no longer directed against the surface of load roll 17 by the weight of partial web rolls 14, 15, and 16.

Support 7 may be located in an opening 20 of a mounting plate 21, e.g., a foundation. When Support 7 is located in a set-up position, i.e., the rotational axes 25, 26, and 27 are substantially horizontally oriented, e.g., as shown in FIG. 1, an operator can cross over from mounting plate 21, which lies in substantially a same horizontal plane as support 7, to support 7. In this manner, the operator may access material web 9 and/or partial webs 11, 12, and 13. When the set-up is complete, support 7 can be pivoted, e.g., via a drive 22, into a winding position, i.e., the rotational axes 25, 26, and 27 are substantially vertically oriented, e.g., as shown in FIG. 2. In this regard, drive 22 may be coupled to a pinion 23 that is in turn coupled to a corresponding gear wheel 24 on hinge pin 8.

It is noted that, if desired, cutting station 6 may be omitted, and the device may be utilized, e.g., for rewinding. Again, the set-up position for rewinding may be as depicted in FIG. 1, while actual rewinding may occur when placed in the winding position shown in FIG. 2 without the influence of the force of the roll weight.

When the winding is complete, i.e., either via reel cutting or rewinding, support 7 may be pivoted back into the set-up position shown in FIG. 1 to that the operator may have easier access possibilities to the rolls. This may be particularly advantageous in the case of wider rolls.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A roll winding device comprising:

an unwinding station;

a winding station;

both the unwinding station and the winding station comprising a pivotable rotational axis adapted to pivot between a substantially vertical orientation and a substantially horizontal orientation.

2. The roll winding device in accordance with claim 1, wherein the substantially vertical orientation of the pivotable rotational axis is a winding position, and wherein the substantially horizontal orientation of the pivotable rotational axis is a set-up position.

3. A roll winding device comprising:

an unwinding station;

a winding station;

both the unwinding station and the winding station comprising a pivotable rotational axis adapted to pivot between a substantially vertical orientation and a substantially horizontal orientation; and a coupling device adapted for synchronous pivoting of the pivotable rotational axes.

4. The roll winding device in accordance with claim 3, further comprising a common support, both the unwinding station and the winding station being coupled to the support; and a hinge pin coupled to the support to form a rotational axis of the support that is substantially perpendicular to the pivotable rotational axes.

5. The roll winding device in accordance with claim 4, the hinge pin being laterally offset from the pivotable axes rotation.

6. The roll winding device in accordance with claim 4, the hinge pin being positioned in a middle of the support.

7. The roll winding device in accordance with claim 4, further comprising a mounting plate having an opening; and the support being arranged in the opening in a mounting plate.

8. The roll winding device in accordance with claim 4, further comprising a cutting station coupled to the support.

9. The roll winding device in accordance with claim 4, further comprising a rotational drive coupled to the support.

10. A roll winding device comprising:

an unwinding station;

a winding station;

at least one of the unwinding station and the winding station comprising a pivotable rotational axis adapted to pivot between a substantially vertical orientation and a substantially horizontal orientation; and a load roll adapted to pivotably rotate with the pivotable rotational axis.

11. A method for winding at least one winding roll from a jumbo roll, the at least one winding roll and the jumbo roll being coupled to a pivotable support, the method comprising:

substantially horizontally orienting a rotational axis of at least one of the at least one winding roll and the jumbo roll;

pivoting the rotational axis; and substantially vertically orienting the rotational axis.

12. The method in accordance with claim 11, further comprising:

while the rotational axis is substantially horizontally oriented, guiding a material web from the jumbo roll to the at least one winding roll; and winding the material web onto the at least one winding roll.

13. The method in accordance with claim 11, further comprising:

while the rotational axis is substantially vertically oriented, winding the material web onto the at least one winding roll.

14. The method in accordance with claim 11, wherein the at least one winding roll comprises a plurality of winding rolls, and the method further includes:

cutting the material web into a plurality of partial webs; and winding the plurality of partial webs onto the plurality of winding rolls.

15. The method in accordance with claim 11, further comprising:

pivoting the rotational axis around an axis formed by a hinge pin laterally offset from the rotational axis.

16. The method in accordance with claim 11, wherein the pivoting of the rotational axis comprises pivoting the support.

17. The method in accordance with claim 11, wherein the at least one winding roll comprises a plurality of winding rolls, and the method further includes:

substantially horizontally orienting rotational axes of the plurality of winding rolls and of the jumbo roll; and pivoting the rotational axes.

18. The method in accordance with claim 11, further comprising:

positioning a load roll against the at least one winding roll.

19. The method in accordance with claim 18, further comprising:

pivoting the load roll with the rotational axis.

* * * * *